United States Patent [19]

Eisenhart

[11] 4,280,112

[45] Jul. 21, 1981

[54] ELECTRICAL COUPLER

[76] Inventor: Robert L. Eisenhart, 6180 Dalecrest Ave., Woodland Hills, Calif. 91364

[21] Appl. No.: 13,605

[22] Filed: Feb. 21, 1979

[51] Int. Cl.[3] ..... H01P 5/08; H01P 1/04; H01P 3/08

[52] U.S. Cl. ..... 333/21 R; 333/34; 333/246; 333/260

[58] Field of Search ..... 333/32–35, 333/21 R, 21 A, 245–246, 254–255, 260

[56] References Cited

U.S. PATENT DOCUMENTS

| | | | |
|---|---|---|---|
| 3,553,607 | 1/1971 | Lehrfeld | 333/34 |
| 3,622,915 | 11/1971 | Davo | 333/34 |
| 3,686,624 | 8/1972 | Napoli et al. | 333/238 |
| 3,705,379 | 12/1972 | Bogar | 333/21 R X |
| 3,725,829 | 4/1973 | Brown | 333/32 X |

*Primary Examiner*—Marvin L. Nussbaum

*Attorney, Agent, or Firm*—Jackson, Jones & Price

[57] ABSTRACT

An electrical coupler for transmitting high frequency electrical signals from a coaxial transmission to a microstrip transmission line. The coupler is adapted to match the characteristic impedance of the two media and the electromagnetic field patterns of the two media at the interfaces therewith. The coupler provides a transition having a very low reflections at frequencies at least up to 18 GHz. The preferred embodiment transitions utilize a cylindrical outer conductor and an inner conductor which is centered relative the outer conductor at the coaxial end of the coupler and gradually shifted offcenter so that it is very near the outer conductor at the microstrip end of the coupler. The characteristic impedance of the coupler is maintained at a constant value by appropriate variation of the inner conductor. Other features are disclosed.

20 Claims, 10 Drawing Figures

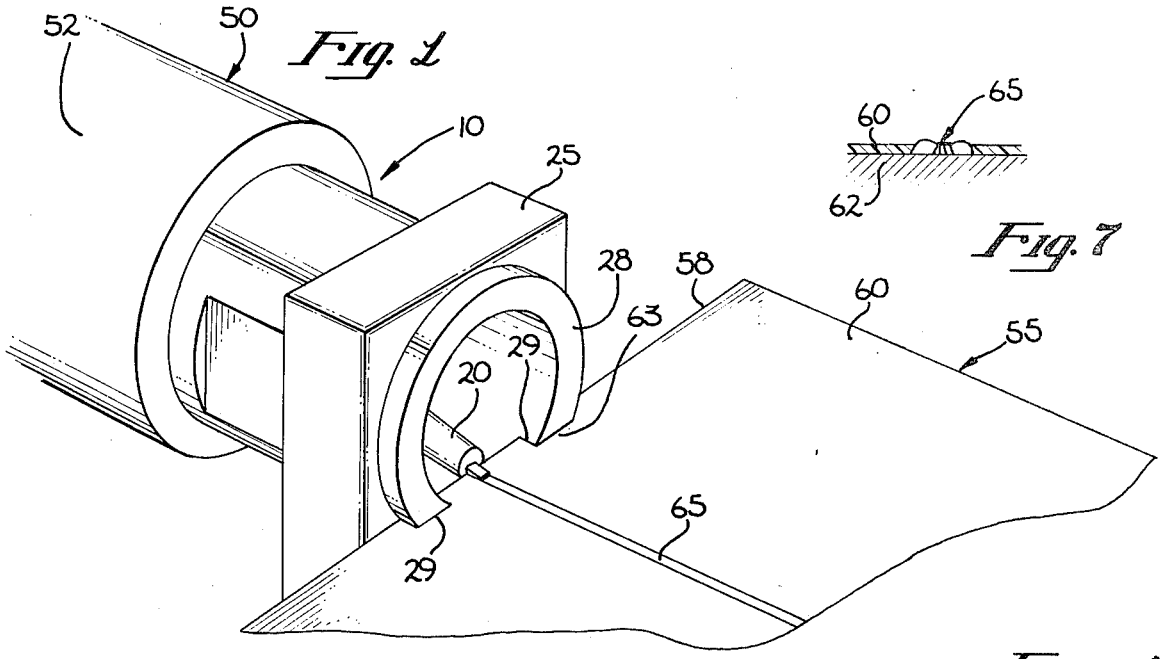
Fig. 1
Fig. 7
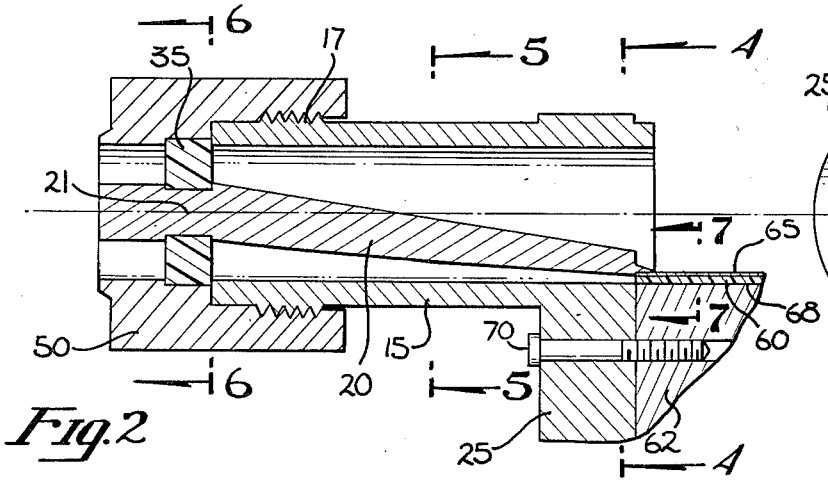
Fig. 2
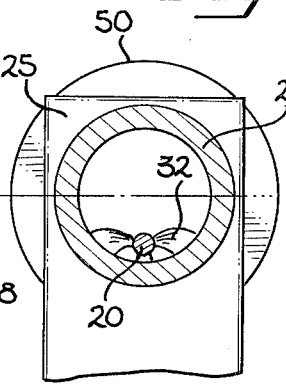
Fig. 4
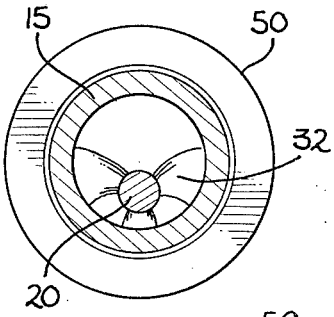
Fig. 5
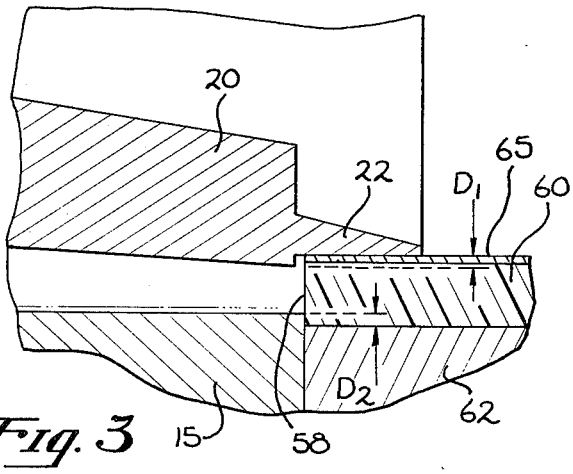
Fig. 3
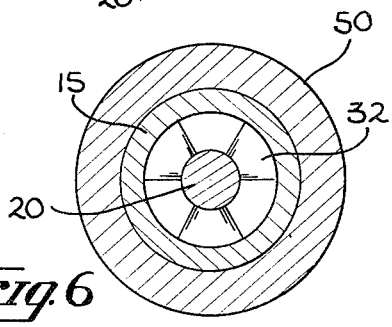
Fig. 6

Fig. 10
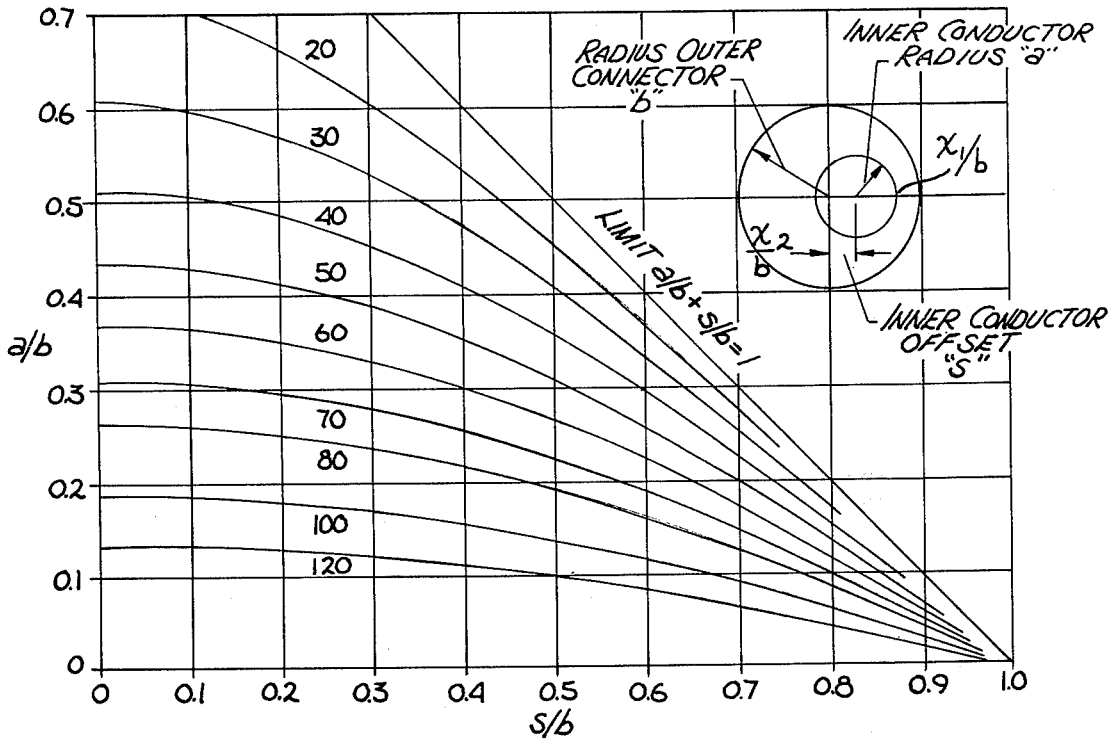
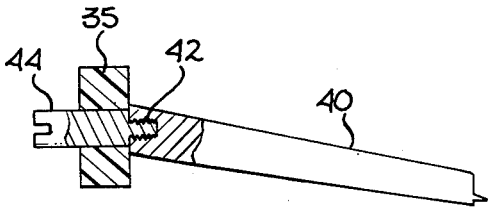
Fig. 8
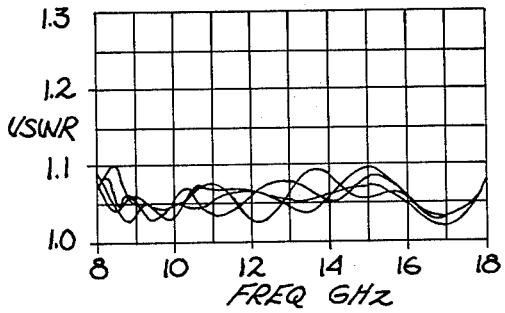
Fig. 9

ELECTRICAL COUPLER

BACKGROUND OF THE INVENTION

1. Field of the Invention

The field of the present invention is electrical devices, and, more particularly, electrical couplers adapted to efficiently transmit high frequency electrical signals.

2. Description of the Prior Art

The design processes for microwave circuits are extremely dependant upon the ability to accurately measure the characteristics of these circuits. To aid in this cause, a great variety of sophisticated measurement equipment has been generated. Unfortunately for the designer working in the microstrip transmission medium, all of this equipment is designed to interface with coaxial or waveguide systems, and a good transition device is necessary to properly utilize this analysis equipment with microstrip lines. The presently available transitions introduce power reflections on the order of 1.8% (VSWR=1.3:1) in the frequency range up to 18 HGz, which can result in impedance measurement errors of 30%. The measurement errors introduced by the transition devices dominate the inaccuracies due to the measurement equipment, thus limiting the overall measurement capability.

One type of prior art coupler shown in U.S. Pat. No. 3,553,607, issued to Lehrfield. The patent shows a connector comprising a mounting plate having a hollow cylindrical section projecting from one surface thereof, threadingly engaging the terminal member of a coaxial line. The hollow interior of the cylindrical portion is fitted with an annular insulating member which supports a conductive pin in a colinear fashion with respect to the center axis of the hollow member. This pin is adapted at one end to couple to the coaxial line center conductor, and its opposite end tapered to form a frusto-conical section, with a short tab extending therefrom to connect to the microstrip conductor. The mounting plate is mounted to the insulating block of the microstrip by screws. A low VSWR for the connector is claimed for frequencies up to 12 HGz. It is clear, however, that the connector does not achieve electromagnetic field matching at the microstrip to coaxial interface; the performance at higher frequencies necessarily is degraded.

Another prior art coupler is shown in U.S. Pat. No. 3,622,915 issued to Davo. The coupler comprises a cylindrical outer conduit with a ramplike conductive member disposed at one end thereof, and an inner conductor having one end adapted to couple to the inner conductor of the coaxial line with a tapered central portion having a slot formed therein to receive a flat strip of conductive material for engaging the conductor of the microstrip. It is claimed that low VSWR is achieved by the connector up to 12 GHz. if the length of the tapered portion of the center conductor exceeds 10 times the difference between its initial and final diameter sizes. However, due to the unusual geometry of the device, it would be extremely difficult to calculate the characteristic impedance of the coupler along its length, and to accurately characterize the device for data interpretation purposes. The 12 Ghz upper limit is relatively low for the high frequency investigations common today.

SUMMARY OF THE INVENTION

A coupler for coupling high frequency electrical energy from a coaxial line to microstrip and introducing very low reflections is disclosed. The coupler is comprised of a hollow cylindrical outer conducting member, and a tapered inner conducting member which is disposed concentrically within the outer member at its first end and is gradually offset relative to the axis of the outer conductor such that the second end of the inner member is disposed in close proximity to the outer member at its second end thereof. The first end of the outer member is adapted to couple to the outer conductor of the coaxial line, and the second end thereof is formed with position registration surfaces for accurately positioning the coupler in relation to the microstrip.

The inner member has a substantially circular cross-section, and its second end is formed with a cantilevered tip for engagement with the top conductor of the microstrip. An upright planar face member is affixed perpendicularly to the second end of the outer conducting member for affixing the coupler end to a support block of the microstrip.

The diameter of the coupler center conductor, which decreases from its first to second end, is selected such that the characteristic impedance of the coupler, computed along its length, remains substantially constant. The gradual shifting of the center conductor offcenter effects a smooth transition of the electromagnetic field configuration between the evenly distributed fields at the coaxial end to the highly concentrated fields at the microstrip end. The ability to maintain a constant characteristic impedance and, at the same time to match the electromagnetic field at the coaxial end and at the microstrip end, allows the user of the coupler to model the coupler as a simple length of coaxial line with the characteristic impedance of the coupler.

BRIEF DESCRIPTION OF THE DRAWINGS

FIG. 1 is a perspective view showing the preferred embodiment of the present invention disposed between a coaxial line and a microstrip line.

FIG. 2 is a lengthwise cross sectional view of the electrical coupler of the present invention.

FIG. 3 is an enlarged cross sectional view of the tip of the inner connector of the disclosed electrical conductor, showing the interface between the conductor tip and the microstrip.

FIG. 4 is a cross sectional view of the electrical coupler taken through line 4—4 shown in FIG. 2, depicting the electrical field configuration at the plane at 4—4.

FIG. 5 is a cross sectional view of the electrical coupler taken through line 5—5 shown in FIG. 2, depicting the electrical field configuration at the plane at 5—5.

FIG. 6 is a cross sectional view of the electrical coupler taken through line 6—6 shown in FIG. 2, depicting the electrical field configuration at the plane at 6—6.

FIG. 7 is a cross sectional view of a microstrip line depicting the electrical field configuration.

FIG. 8 is a cross sectional view of an alternate embodiment of the coupler inner conductor.

FIG. 9 is a plot of the measured VSWR data of the coupler under specified conditions as a function of frequency.

FIG. 10 is a plot providing information concerning relative dimensions of the components of the electrical coupler.

DETAILED DESCRIPTION OF THE INVENTION

The present invention comprises a novel coaxial line to microstrip line coupler. The following description of the invention is provided to enable any person skilled in the microwave arts to make and use the present invention and sets forth the best modes contemplated by the inventor of carrying out his invention. Various modifications, however, to the preferred embodiments, will be readily apparent to those skilled in the art, and the generic principles defined herein may be applied to other embodiments. Thus, the present invention is not intended to be limited to the embodiment shown but is to be accorded the widest scope consistent with the principles and novel features disclosed herein.

Referring now to FIG. 1, the coupler 10 is shown in perspective view disposed between coaxial line 50 and microstrip transmission line 55. As is well known, the coaxial line 50 comprises a cylindrical hollow outer conductor 52 and a cylindrical inner connector fixed concentrically within the outer conductor 52. Based upon the physical dimensions of the inner and outer conductors and the dielectric constant of the material within the annular space between the two conductors, a characteristic impedance of the line may be computed. The most common characteristic impedance is 50 ohms. A widely used coaxial line connector for high frequency application is the 7 mm precision connector; the present embodiment is readily adaptable for coupling to this standard coaxial connector.

Also as is well known, the microstrip transmission line comprises a lower conductor 68 applied to one side of a planar substrate block, and a conductive strip or upper conductor 65 applied to the opposite side of the substrate block. By selection of the substrate material and the thickness of the substrate block, and the widths of the conductors 65 and 68, the electrical properties of the microstrip line 55 may be varied. A typical substrate material is alumina, particularly desirable because of its relatively high dielectric constant and consequent concentration of the electromagnetic fields. A standard substrate thickness is 25 mils; from these parameters and the conductor dimensions of the top conductor 65, a characteristic impedance for the microstrip may also be calculated; again a typical impedance utilized is 50 ohms, in a configuration wherein the lower conductor is a ground sheet conductor.

From the foregoing, if both the coaxial line and microstrip have characteristic impedances of 50 ohms, it will be readily apparent that a coupler for effectively transitioning from the coaxial line 50 to the microstrip 55 should present an impedance of 50 ohms both to the coaxial line 50 and the microstrip 55 to prevent impedance mismatches and consequent reflection of energy at the transitions.

It has been found that, to achieve an extremely low reflections over the desired wide frequency range, the configuration of the electromagnetic fields at both the coaxial line and the microstrip should also be matched. The electrical coupler shown maintains a substantially constant impedance along its length and further accomplishes close matching of the electromagnetic field configurations at each end thereof to a degree unattained by prior art devices.

The coupler of the present invention accomplishes this novel result in the following manner. The coupler 10 includes cylindrical outer conductor 15 and inner conductor 20 which is tapered from the coaxial end to the microstrip end of the coupler; the inner conductor 20 is concentrically positioned with respect to the outer conductor 15 at the coaxial end of the coupler, and is gradually shifted off-center with respect to outer conductor 15 so that at the microstrip end of the coupler, the end of inner conductor 20 is disposed very close to the outer conductor 15.

The maintenance of a constant characteristic impedance through the length of the connector is achieved through appropriate selection of the dimensional relationship between the outer and inner conductor sizes, and the offset of the inner conductor with respect to the axis of the outer conductor. Standard formulas for calculating the characteristic impedance of coaxial lines of course do not apply to such large offsets of the inner conductor. Accordingly, a technique utilizing a conformal transformation of the offset configuration into a concentric configuration image plane is used to provide an accurate relationship for the characteristic impedance of the coupler for a variety of different parameter values.

In the book, *Complex Variables and Applications* by Ruel V. Churchill (Second Edition, McGraw Hill, 1960), the desired conformal transformation for this situation is derived and shown at page 287, in FIG. 14 (which is by this reference incorporated herein). The image plane of the offset configuration depicted in the upper right hand corner of FIG. 10 may be described as an outer conductor having a radius Ro and an inner conductor of unit size, i.e. the ratio of outer conductor radius to inner conductor radius may be normalized to the inner conductor radius. The parameter Ro is described by the conformal transformation given in *Complex Variables and Applications* as $$Ro = \frac{1 - x_1x_2 + \sqrt{(1 - x_1^2)(1 - x_2^2)}}{x_1 - x_2} \quad (1)$$

$$Ro > 1 \text{ when } -1 < x_2 < x_1 < 1$$

The variables $x_1$ and $x_2$ are related to the parameters "a," the inner conductor radius, and "s," the offset dimension of the inner conductor (each of these parameters is depicted in FIG. 7), as follows:

$$a=(x_1-x_2)/2 \quad (2)$$

$$s=(x_1+x_2)/2 \quad (3)$$

Since the characteristic impedance of a configuration remains constant through the transformation into the image configuration, it is possible to describe the offset configuration impedance by calculating the impedance of the image. The relationship for the concentric case is:

$$Zo=60 \ln(Ro) \text{ (air dielectric)} \quad (4)$$

In the desired case of a 50 ohm characteristic, impedance Ro is approximately 2.3. A range of values for $x_1$ (or $x_2$) may be selected, and the corresponding values of $x_2$ (or $x_1$) computed in accordance with Equation 1; the values of the inner conductor radius "a" and offset "s" may be computed in accordance with Equation 3 and 4. Thus, for a selected characteristic impedance, a plot of the inner radius as a function of the offset dimension may be generated, and is shown in FIG. 10, for several selected Ro values representing various characteristic impedance values.

The above described relationships may then be used to calculate, for a given outer conductor size, the appropriate inner conductor size "a" for a given offset dimension "s". A coupler having a tapered inner conductor which is gradually shifted offcenter can be designed with a substantially constant characteristic impedance along its length. Yet such a coupler, even though matching the characteristic impedances of the coaxial line and microstrip line, will not necessarily provide a low reflection transition unless the electromagnetic field configurations are also matched. The mismatched transmission line fields of prior art designs are balanced physically at the interface through the generation of more complex local fields which in turn produce the undesirable reflections. This is one of the respects in which prior art devices have failed. The conformal transformation between the offset and concentric configurations may again be utilized to calculate the electric field configurations in the offset configuration.

As is well known, the field lines in the concentric coaxial configuration extend radially and are equally distributed; the fields will be orthogonal to the surfaces of the inner and outer conductors. These radial field lines in the concentric configuration are transformed into the corresponding offset configuration to show the corresponding field lines in the offset configuration. This is accomplished by transforming individual points of a radial field line into the corresponding image points in the offset configuration.

Referring now to FIG. 6, a crossectional view is shown taken through line 6—6 near the coaxial line end of the coupler when the inner conductor is centered. Depicted in FIG. 6 are the evenly distributed (one every 60°) radial field lines of the concentric configuration of the coupler at the plane at line 6—6. FIGS. 4 and 5 depict the image field lines, as transformed, at the planes at lines 4—4 and 5—5, respectively. FIG. 5—5 represents an intermediate offset configuration, and FIG. 4—4 a highly offset configuration. It is apparent that, as the inner conductor is shifted off-center and tapered, the fields are gradually more concentrated in the region between the inner conductor and the adjacent portions of the outer conductor.

The field configuration for the microstrip transmission line, is, in the case of a substrate dielectric having a high dielectric constant, such as alumina, highly concentrated between the ground plane conductor and the upper conductor. This field configuration is depicted in FIG. 10. One of the objects of the present invention is to provide a coupler which matches, as closely as possible, the electromagnetic field configuration at the microstrip transmission line. Accordingly, an offset dimension at the microstrip end of the conductor is selected which yields a field configuration which closely matches the field configuration as shown in FIG. 7. The conformal transformation may be used to produce a number of transformed field configurations corresponding to a variety of small offsets (each with the requisite characteristic impedance). An offset dimension may then be selected.

As an example of a coupler constructed in accordance with the present invention for use in connection with a 7 mm precision precision coaxial connector and a microstrip line having a 25 mil alumina substrate, the outer conductor inner diameter may be 0.2756 inches, and the length thereof 1.0 inches. The length of the tapered offset inner conductor may be 1.0 inches and the diameters thereof at 0.1 inch intervals is given in Table 1 (L is zero at the coaxial end of the inner conductor).

TABLE I

| L (inches) | 0 | 1 | 2 | 3 | 4 | 5 | 6 | 7 |
|---|---|---|---|---|---|---|---|---|
| Diameter at | .1198 | .1191 | .1171 | .1138 | .1091 | .1034 | .0962 | .0882 |
| | | | | L (inches) | | 8 | 9 | 1.0 |
| | | | | Diameter at | | .0794 | .0695 | .0593 |

The required offset at each dimension may be obtained by reference to FIG. 10.

Another feature of the present invention is best illustrated in FIG. 1. An upright block member 25 is disposed adjacent the microstrip substrate 60 and the commonly used support layer 62. The block member may be either integrally fabricated with the outer conductor 15, or may be fabricated as a separate member adapted to couple together with outer conductor 15. Block number 25 acts as a positioning member for precisely positioning the coupler against the end of microstrip 55. Thus, the coupler position in relation to the adjacent end of the microstrip line is determined by the block member 25. Block member 25 also provides a convenient means to securely affix the coupler to the microstrip, conventional screw members 70 may be inserted through holes in the block member for disposition into microstrip support layer 62. Block member 25 also provides electrical continuity with microstrip lower conductor 68.

As a further positioning means, block 25 is preferably provided with registration shoulder 28. Shoulder 28 may be an extension of cylindrical outer conductor 15, with the portion thereof removed below a chord extending parallel with upper surface 63 of microstrip substrate 60, the removed portion extending back to block 25. Thus, registration surfaces 29 are formed for providing precise registration of the coupler relative to the upper surface 63 of substrate 60. The step defined by surfaces 29 and the adjacent surface of block 25 thus precisely position the coupler in relation to the microstrip line. As will be apparent from the above discussion, the electrical performance of the coupler is dependant upon accurate offset positioning of the inner conductor relative to the outer conductor. Shoulder 28 facilitates accurate positioning of the coupler relative to substrate surface 62, and together with the configuration of tip 22 of inner conductor 20, allows the desired offset position of the conductor 20 to be reliably maintained.

Referring now to FIG. 3, an enlarged view of the tip 22 of conductor 20 and microstrip 55 is shown. Conductor 20 is provided with an extending tip 22 for extending onto and achieving electrical contact with upper conductor 65. The upper face of conductor 20 is slighly offset away from the microstrip. Also, as is shown in FIG. 3, a portion of conductor 20 extends below conductor 65; the dimension D1 is, for a 25 mil substrate thickness, about 5 mils. Similarly, outer conductor 15 extends above lower conductor 68 a distance D2 of about 5 mils. This configuration is found to lessen the effect of any discontinuities at the coupler-microstrip interface. Conductor 20 preferably includes an additional angular offset to provide a spring effect to achieve good electrical contact with conductor 65; when in proper position against the microstrip, the inner conductor is urged into the calculated offset condition relative to the outer conductor.

A further novel feature of the present invention is the absence of any dielectric at the couplers-microstrip transition; prior art devices have relied upon a dielectric block at this position to press the center conductor against the microstrip conductor. The spring effect of the inner conductor eliminates the need for such dielectric material by maintaining good electrical contact.

Further details of the construction of the coupler are illustrated in FIGS. 1 and 8. A standard commercial dielectric bead 35, of circular crossection, is used to concentrically position end 21 of the inner conductor 20 relative to outer conductor 15. End 21 is provided with conventional means to couple to the inner conductor of the coaxial line. This coupling means may be fabricated integrally with inner conductor 20, as depicted in FIG. 1. FIG. 8 shows an alternative embodiment wherein inner conductor 40 is provided with threaded bore 42 for receiving threaded stud 43 of coupling means 44. This allows the use of means 44 and bead 35 with inner conductors of varying dimensions. The outer conductor 15 may be provided with conventional means, such as threaded surfaces 17 or the like, for coupling to the outer conductor of the coaxial line.

The coupler constructed in accordance with the present invention have been found to exhibit extremely low reflection characteristic across wide frequency ranges. FIG. 9 is a plot of measured data for the transition from 7 mm coaxial line to 25 mil alumina substrate microstrip for four positions of a sliding load on the microstrip. With such low VSWR across the frequency band representing power reflections of typically less than 0.15%, impedance measurements can be made with error less than 7%. Consequently, the coupler may accurately be characterized as a length of 50 ohm coaxial line, which can easily be accounted for in data interpretation. Thus, the present invention provides a transition of low reflections from coaxial to microstrip lines, across a wide frequency band. The practical upper frequency limit of devices built in accordance with the present invention has not been established, due to the frequency limitations of the measurement equipment.

It will be readily apparent to those skilled in the art that the principles of the present invention may be applied to an embodiment wherein the inner conductor is cylindrical with the same cross-sectional dimension along the length thereof, and the outer conductor is tapered from the coaxial end to the microstrip end of the coupler. With the offset in the inner conductor, a constant characteristic impedance can be maintained along the length of the coupler. With appropriate selection of parameters the conformal transformation will apply to this embodiment also, and the appropriate offset may be determined, as before. A gradual concentration of the fields in the coupler will occur, as in the embodiment of FIG. 1, and a constant characteristic impedance maintained along the length of the coupler.

What is claimed is:

1. An electrical coupler for electrically connecting a coaxial transmission line to a microstrip transmission line comprising:

outer conductor means having first and second ends, said first end adapted for coupling to the outer conductor of said coaxial line, said second end adapted for coupling to a first conductor of such microstrip transmission line;

inner conductor means adapted for disposition within said outer conductor means, having first and second ends, said first end adapted for coupling to the inner conductor of said coaxial line, said second end disposed offset relative to the axis of said outer conductor of said microstrip transmission line, said inner conductor means gradually shifted off-center relative to said axis of said outer conductor means from said first end to said second end thereof.

2. The coupler of claim 1 wherein the cross-sectional dimensions of the outer and inner conductor means and the offcenter position of said inner conductor means relative to said outer conductor means along the length thereof are such that a substantially constant characteristic impedance is maintained along the length of the coupler.

3. The coupler of claim 1 wherein said second end of said inner conductor means is disposed a predetermined distance from said second end of said outer conductor means, said distance determined by the parameters of the microstrip transmission line.

4. The coupler of claim 1 further comprising positioning means for positioning said coupler relative to the end surface of said microstrip line.

5. The coupler of claim 1 wherein said positioning means comprises a block member disposed adjacent said second end of said outer conductor means for butting against said end surface of said microstrip line.

6. The coupler of claim 1 further comprising positioning means for positioning said coupler in relation to a planar surface of the microstrip line.

7. The coupler of claim 6 wherein said positioning means comprises a step surface disposed at said second end of said outer conductor means.

8. The coupler of claim 6 wherein said second end of said inner conductor means is adapted for disposition a predetermined distance from said second end of said outer conductor means, and said offset is larger than required for disposition of said second end of said inner conductor means at said predetermined distance, said positioning means urging said second end of said inner conductor means into location at said predetermined distance.

9. The coupler of claim 1 wherein said outer conductor means is a substantially cylindrical member.

10. The coupler of claim 8 wherein said first end of said inner conductor means is disposed generally concentrically with said outer conductor means.

11. An electrical coupler electrically coupling a coaxial transmission line to a transmission medium comprising a planar dielectric layer having first and second conductors on opposite sides thereof, the coupler comprising:

outer conductor means having a first end adapted for coupling to the outer conductor of the coaxial line and a second end adapted for coupling to the first conductor of such transmission medium; and inner conductor means disposed within said outer conductor means and having a first end adapted for coupling to the inner conductor of the coaxial line and a second end adapted for coupling to the second conductor of such transmission medium and disposed offset relative to the axis of said outer conductor means, said inner conductor tapered from said first end to said second end.

12. The coupler of claim 11 further comprising centering means for concentrically disposing said first end of said inner conductor means relative to said outer conductor means.

13. The coupler of claim 12 wherein said centering means is adapted to support said coupling means.

14. The coupler of claim 11 wherein said inner conductor means is gradually shifted off-center relative to said axis of said outer conductor means from said first end to said second end thereof.

15. The coupler of claim 14 wherein said inner conductor means is of substantially circular cross-section.

16. The coupler of claim 11 wherein the cross-sectional dimensions of the inner and outer conductor means and the off-center position of said inner conductor means along the length thereof relative to the outer conductor means are such that a substantially constant impedance is maintained along the length of such coupler.

17. The coupler of claim 16 wherein said second end of said inner conductor is disposed a predetermined distance from second end of said outer conductor means, said distance being dependant upon the parameters of such transmission medium.

18. An electrical coupler for electrically connecting a coaxial transmission line to a microstrip transmission line comprising:

generally cylindrical outer conductor means having first and second ends, said first end having means for coupling to the outer conductor of said coaxial line, said second end having means for coupling to a first conductor of the microstrip line;

inner conductor means adapted for disposition within said outer conductor means and having first and second ends, said first end having means for coupling to the inner conductor of said coaxial line, said second end adapted to couple to a second conductor of the microstrip line, said inner conductor means being shifted gradually offset relative said outer conductor means from said first end to second thereof, said inner conductor means tapered from said first end to said second end thereof;

the dimensions of said outer and inner conductor means such that a substantially constant characteristic impedance is maintained along the length of the coupler.

19. An electrical coupler to provide interconnection between a symmetrical transmission line and an asymmetrical transmission line, the coupler comprising:

outer conductor means having first and second ends, said first end adapted for coupling to a first conductor of such symmetrical transmission line, said second end adapted for coupling to a first conductor of such asymmetrical transmission line;

inner conductor means adapted for disposition within said outer conductor means, having first and second ends, said first end adapted for coupling to a second conductor of said symmetrical transmission line, said second end disposed offset relative to the axis of said symmetrical transmission line, said inner conductor means shifted off-center relative to said axis of said symmetrical transmission line from said first end to said second end thereof.

20. Apparatus electrically coupling a coaxial transmission line having inner and outer conductors to a transmission medium comprising a planar dielectric layer having first and second conductors on opposite sides thereof, comprising:

first conductor means for electrically coupling said outer conductor to such first conductor of such transmission medium;

second conductor means having a first end adapted for coupling to the second conductor of such transmission medium and disposed offset relative to the axis of said outer conductor means, a predetermined length of said second conductor means adjacent said second conductor adapted to be gradually shifted off-center relative to the center axis of said outer conductor.

* * * * *